US005509283A

United States Patent [19]

Lee et al.

[11] Patent Number: 5,509,283

[45] Date of Patent: Apr. 23, 1996

[54] CLOTHES WASHER HAVING WATER RECIRCULATION SYSTEM

[75] Inventors: Jae C. Lee, Suwon; Do W. Kim, Seoul, both of Rep. of Korea

[73] Assignee: Samsung Electronics Co., Ltd., Suwon, Rep. of Korea

[21] Appl. No.: 355,197

[22] Filed: Dec. 8, 1994

[30] Foreign Application Priority Data

Dec. 14, 1993 [KR] Rep. of Korea ..... 93-27703
Mar. 26, 1994 [KR] Rep. of Korea ..... 94-6153 U

[51] Int. Cl.[6] ..... D06F 17/06; D06F 39/10

[52] U.S. Cl. ..... 68/18 F; 68/23.7; 68/53

[58] Field of Search ..... 68/18 F, 23.7, 68/53

[56] References Cited

U.S. PATENT DOCUMENTS 2,270,750 1/1942 Bariffi ..... 68/18 F

FOREIGN PATENT DOCUMENTS 55-24066 2/1980 Japan .
90596 5/1985 Japan ..... 68/53
259695 11/1986 Japan ..... 68/18 F
14896 1/1987 Japan ..... 68/18 F
6473 2/1987 Japan ..... 68/18 F

*Primary Examiner*—Philip R. Coe
*Attorney, Agent, or Firm*—Burns, Doane, Swecker & Mathis

[57] ABSTRACT

A clothes washing machine includes a water container, a spin-drying basket disposed in the container, and an oscillatory agitator disposed at the bottom of the basket. A plurality of upright water passages are formed in a vertical wall of the basket for conducting an upward flow of water generated by the agitator. Each passage includes vertically spaced first and second water outlets disposed above a water level in the basket. The second outlet is disposed below the upper outlet and has a lint filter. A third water outlet is formed in each passage and is disposed below the water level.

10 Claims, 5 Drawing Sheets

CLOTHES WASHER HAVING WATER RECIRCULATION SYSTEM

BACKGROUND OF THE INVENTION

The present invention is related to providing a clothes washing machine having means for circulating water from the bottom of a basket to the top thereof under the action of an oscillating agitator.

A conventional clothes washing machine is configured, as shown in FIG. 6, to provide a water tank 2 which is provided in the inside of a body 1 and containing a predetermined volume of water needed for a washing cycle. A hydrating spinning basket 3 is housed in the tank 2 and has a pulsator 4. A power generating member 5 is provided beneath the tank 2 for transmitting the power to the dehydrating basket 3 or the pulsator 4.

The power generating member 5 comprises a motor 5*a* provided beneath the water tank 2, and a power transmitting element 5*b* for operating the basket 3 and the pulsator 4 by the power of the motor 5*a*.

Further, at a predetermined area of the inner wall of the basket 3 there is formed a water guide duct 3*a* for guiding the water upwardly from the pulsator 4. The water guide duct 3*a* comprises an inlet 3*b* provided at the lower end and receiving the water from the pulsator during the washing and the rinsing cycle, an outlet 3*c* provided at upper end for discharging water, and a filter 3*d* detachedly provided at the front of the outlet 3*c* for collecting lint contained in the discharged water through outlet 3*c*.

The typical conventional art is described in Japanese Patent Laid Open Publication No. 80- 24066 (1980.2.20).

In the washing machine having the above structure, the pulsator 4 is oscillated by the power transmitted from the motor 5*a*, and thus the washing and the rinsing cycle are achieved.

As the rotating pulsator 4 acts as an impeller, part of the washing water is forcefully induced to the inlet 3*b* of the water guide duct 3*a*, and the water through the inlet 3*b* is discharged from the outlet 3*c* of the water guide duct 3*a*, which is circulated during the washing cycle.

While the process can be repeated during the predetermined programmed period, the washing step and the rinsing step are accomplished. The lint accompanying the water is discharged through the outlet 3*c*, and is collected by the filter 3*d*. While the washing machine has a fairly effective washing cycle, it has the following problems.

In both the washing and rinsing cycles, the oscillating pulsator 4 is causes the water to turn into a stream. Since the water tends to be directed to the inlet 3*b* of the water guide duct 3*a* which is formed as a single opening in the inner wall of the basket 3, a swirling effect of the water occurs particularly adjacent to the inlet 3*b*. The swirling of the water causes the clothes to become extremely twisted. Additionally, since the stream of water is concentrated adjacent to the single inlet, no effective circulation of the water can be achieved and not enough detergent can be dissolved which decreases the cleaning efficiency of the washer. Further, the undissolved detergent is drained with the drain water which results in a waste of detergent and water pollution.

Furthermore, above-described swirling generated by the rotation of the pulsator raises the clothes toward the upper central surface of the water, so the clothes are exposed above the water surface. When this occurs, the washing efficiency decreases.

In order to resolve these problems, one of the main objectives of the present invention is to provide a clothes washing machine having a plurality of passages from which most of the water pours down to the central portion of the dehydrating basket, forming a waterfall, so the clothes which rise above the water surface by the rotation of the pulsator are forced downward until fully immersed, thereby increasing the washing efficiency.

Another objective of the present invention is to provide each passage with a vortex chamber, in which the lint contained in the water is easily separated.

Still another objective of the present invention is to provide each passage with vertically spaced water outlets generating different water heads, in which the clothes in the lower water head as well as the higher water head can be immersed, and the turbulence of the water can easy be developed.

SUMMARY OF THE INVENTION

In order to accomplish these objects, the present invention relates to a clothes washing machine which comprises an upwardly open water container having water therein; a dehydrating basket disposed in the water container; a power transmitting means for transmitting the power of a motor to the dehydrating basket; an oscillatory pulsator disposed in the bottom of the dehydrating basket for being operated by the turning direction of the power transmitting means; an impeller having a plurality of vanes extending radially on the bottom surface of the pulsator; channels attached to the inner wall of the dehydrating basket for guiding the water discharged from the impeller to be run upwardly. Further, the channel has a water inlet at the lower end, a first water outlet at the upper end, and a second water outlet below to the first water outlet, the second water outlet having a lint filter.

Furthermore, at the upper end of the channel there is provided a vortex chamber which curves toward the first water outlet.

Furthermore, a third water outlet is provided below the second water outlet.

BRIEF DESCRIPTION OF THE DRAWINGS

The present invention will now be explained in detail with reference to the attached drawings, in which.

DETAILED DESCRIPTION OF THE PREFERRED EMBODIMENT

Figure 1:
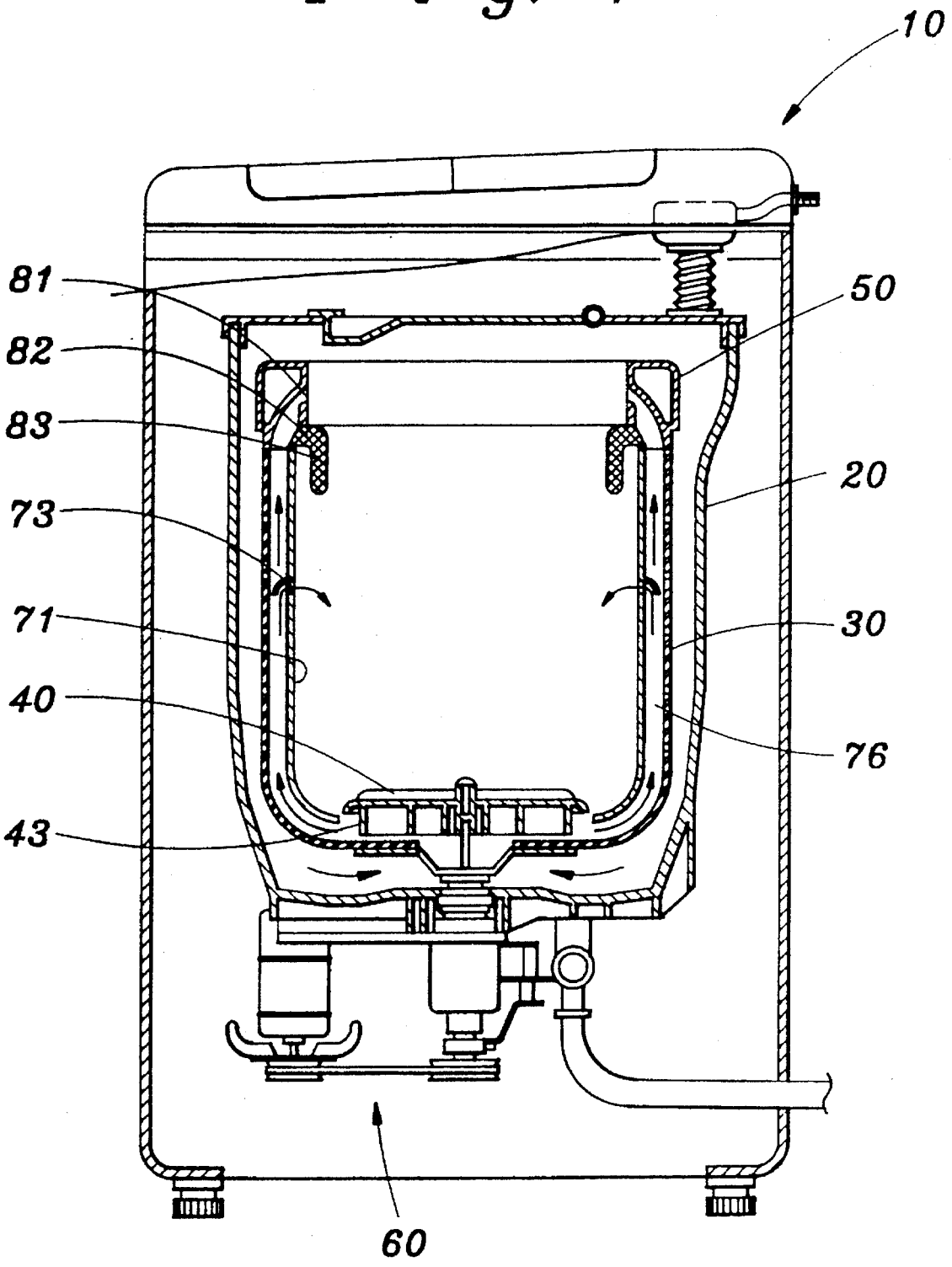
FIG. 1 is a vertical cross-sectional view showing a clothes washing machine provided with a plurality of channels according to the present invention.

FIG. 1 represents a clothes washing machine according to the present invention, which includes a body 10. The body 10 is provided with a water container 20 which retains washing-water therein and a washing tank or dehydrating basket 30 which receives clothing. The dehydrating basket 30 includes a horizontal bottom wall and a cylindrical vertical wall. A balance ring 50 extends around the upper edge of the vertical wall of the basket 30 for preventing the vibration of the basket 30 during the operation. The dehydrating basket 30 further has a pulsator 40 positioned above the bottom of the basket 30, which is connected to a power transmitting means 60 mounted beneath the water container 20.

Further, the pulsator 40 has a plurality of vanes or impeller blades 43 projecting downwardly from the bottom surface of the pulsator 40. Each vane 43 extends in a radial straight direction. The height of the vane 43 is varied to the peripheral from the center of the pulsator 40. That is, the highest wall is in the center of the pulsator 40, while the lowest wall is at the circumference of the pulsator 40. This causes the water in the bottom central portion of the water container 20 to be drawn-in, and the drawn-in water is discharged along the vane in a radial outward direction.

Figure 2:
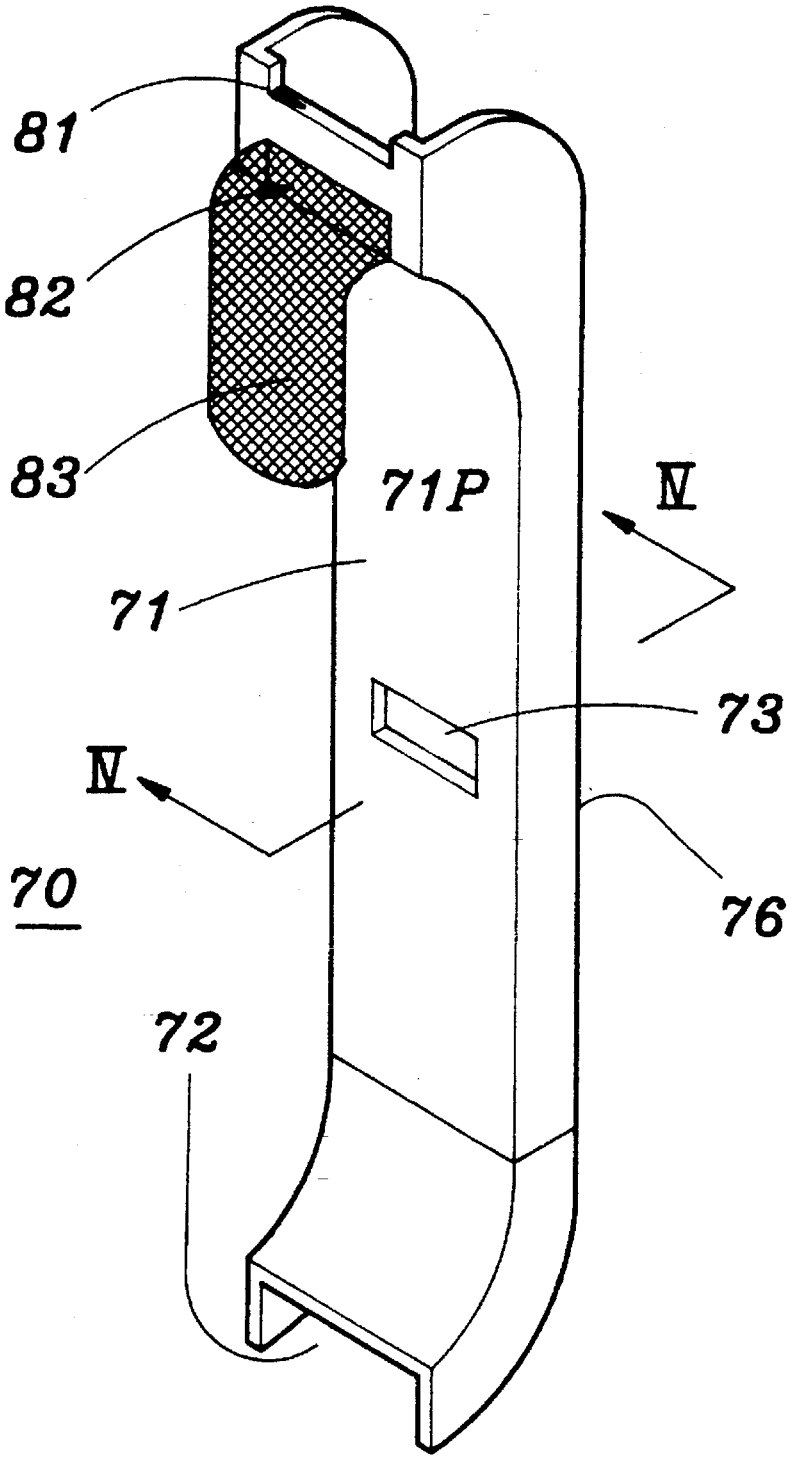
FIG. 2 is a perspective view of a channel of FIG. 1.

Furthermore, a plurality of channels 70 are formed longitudinally, or from the bottom to the upper opening of the basket 30, on the inner wall of the dehydrating basket 30. In FIG. 2, the channel 70 comprises a body 71 having a planar plate 71P extending parallel to and spaced inwardly from the vertical wall of the basket 30, and a pair of side plates 71S which abut the vertical wall of the basket so that there is formed a passage 76 which is bordered by the planar plate 71P, the side plates 71S, and the vertical wall of the basket 30, which passage 76 is utilized for conducting water.

Figure 5:
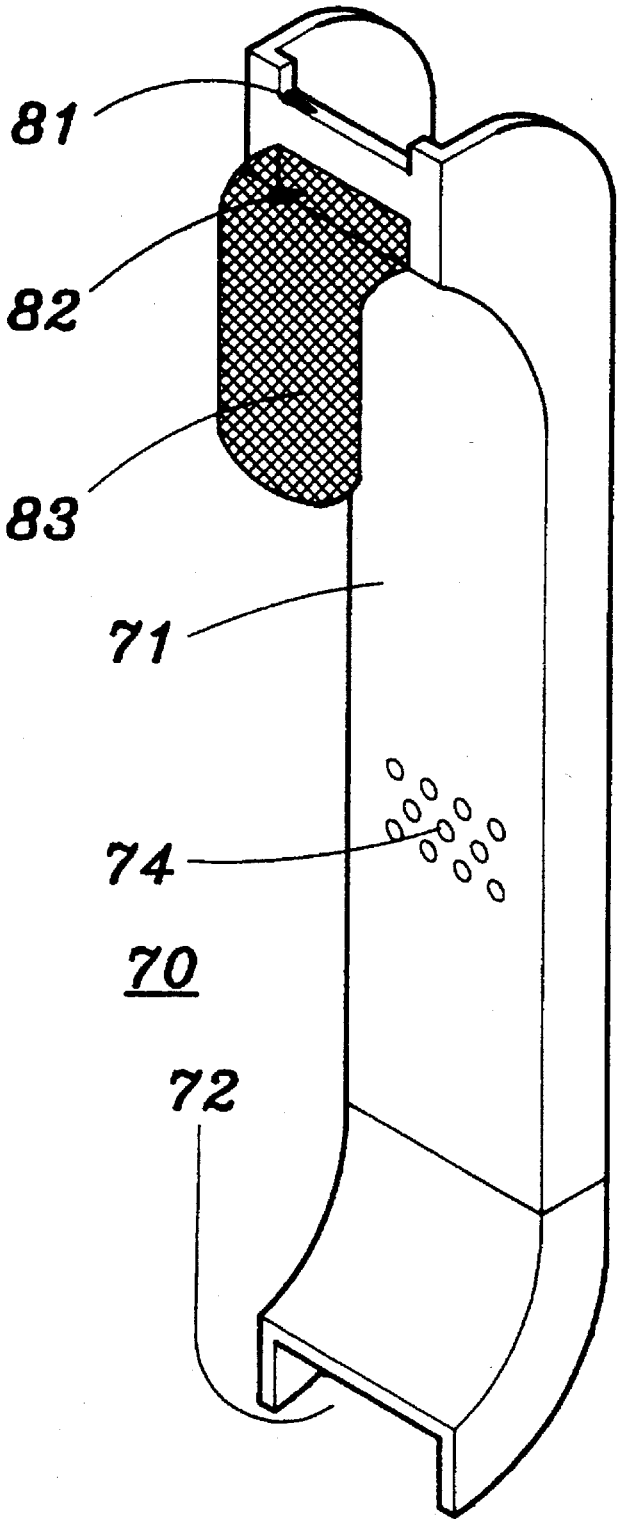
FIG. 5 is a view similar to FIG. 2 of another embodiment of a channel.
Figure 6:
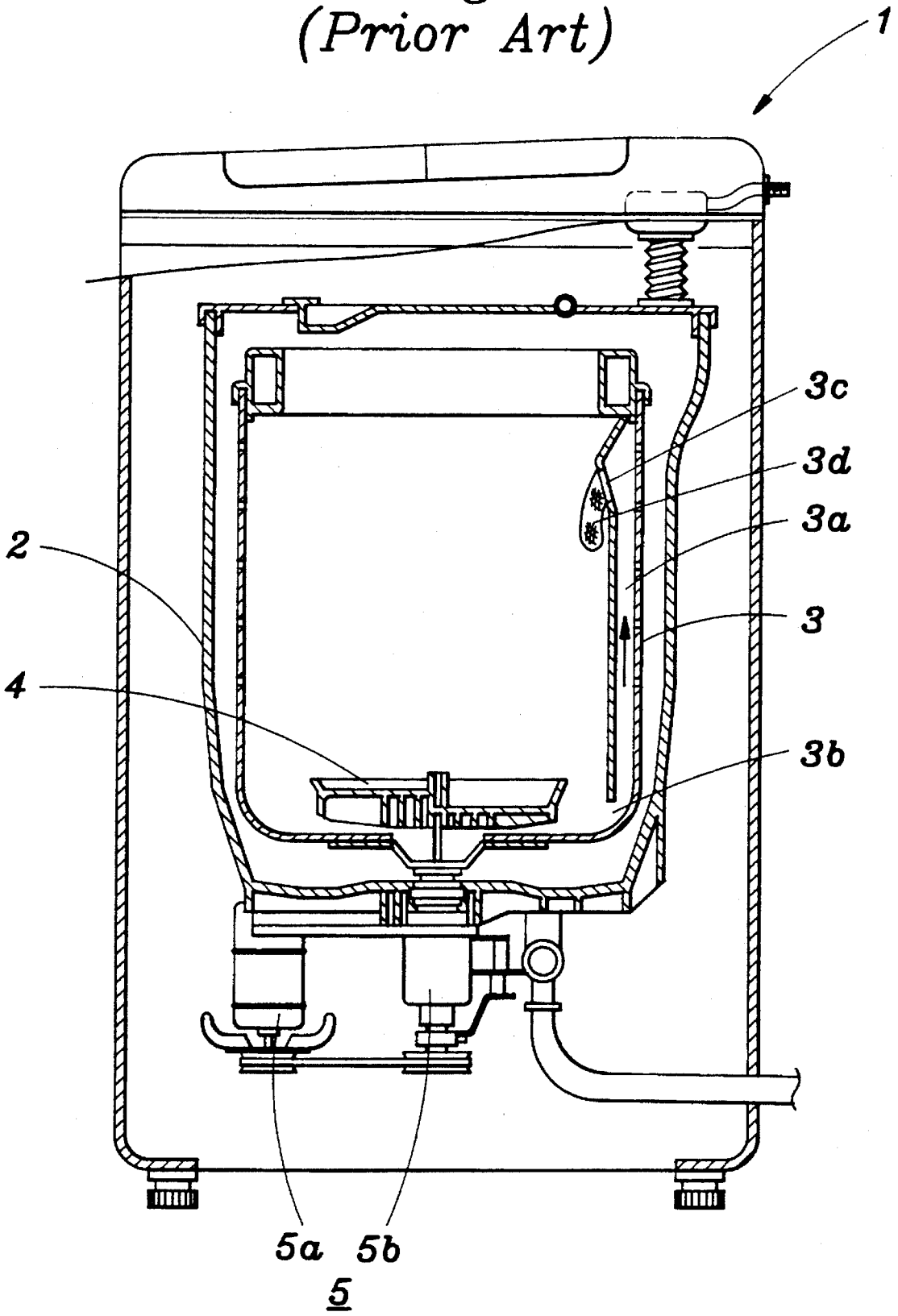
Fig. 6 (Prior Art)
FIG. 6 is a vertical cross-sectional view showing a prior art clothes washing machine provided with a channel.

The channel 70 further comprises horizontally inwardly facing inlet 72 which is formed at the lower end of the body 71 for receiving the water discharged from the ends of vanes 43, a first outlet 81 formed between the upper end of the body 71 and a lower portion of spring 50 for discharging the water running upwardly through the passage 76, and a second outlet 82 formed below the first outlet 81. The second outlet 82 has a filter net 83 which is used for collecting the lint from the water. Further, the first outlet 81 is formed for directing the water from the passage 76 of the body 71 inwardly toward the central portion of the basket 30. The channel 70 furthermore comprises a third outlet 73 formed at the middle of the planar plate 71P of the body 71. At the upper edge of the third outlet 73 is provided a vane 75 extending into the passage 76 for diverting part of the water running upwardly through the passage 76 into the basket 30. Also, the third outlet 73 is formed for directing water toward the peripheral portion of the swirling water in the basket 30. Alternatively, the third outlet 73 might be formed of a plurality of apertures 74 as shown in FIG. 5.

Figure 3:
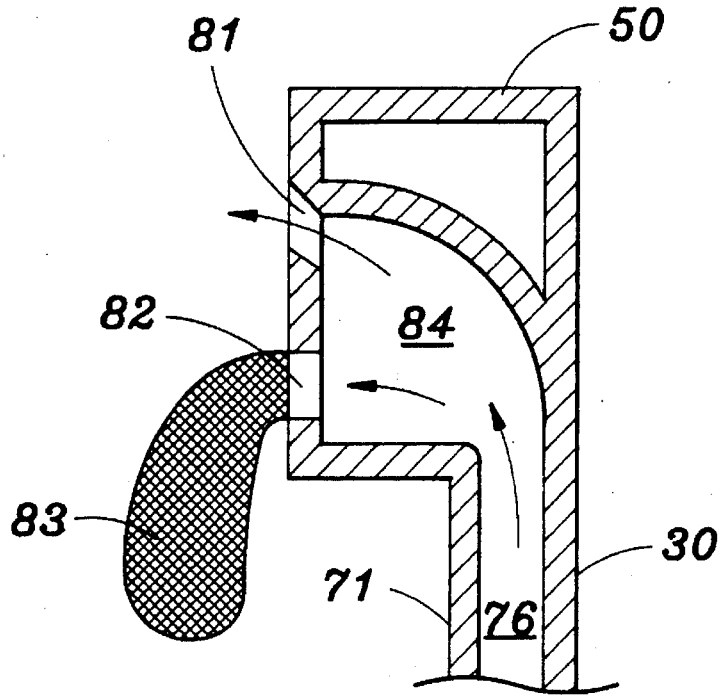
FIG. 3 is a vertical cross-sectional view of an upper end of the channel of FIG. 2.
Figure 4:
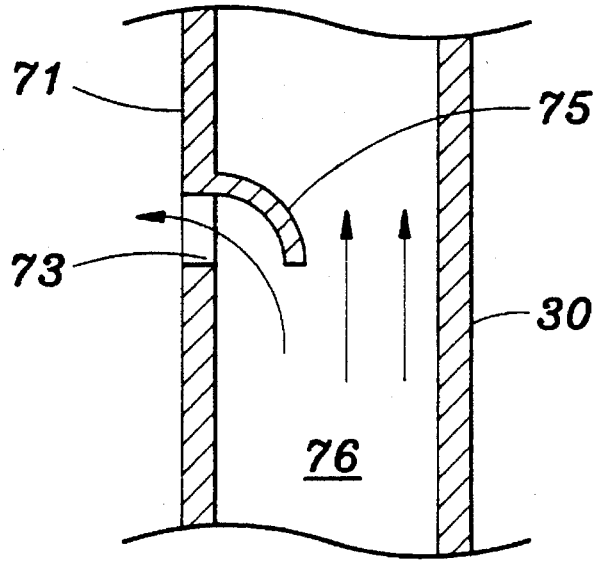
FIG. 4 is a vertical cross-sectional view taken along line IV—IV of FIG. 2.

The upper end of the passage 76 70 is provided with an enlargement defining a vortex chamber 84 with the first outlet 81 and the second outlet 82 disposed at the inward surface of the vortex chamber 84 as shown in FIG. 3. The transverse cross-section of the vortex chamber 84 is wider than that of the passage 76 of the body 71 (see FIG. 3). Thus, the upwardly running water through the passage 76 of the body 71 flows into the vortex chamber 84 to be changed into a vortex flow. The vortex chamber 84 further has a smoothly curved overhead wall formed by a bottom portion of the balance ring 50. The rising water through the passage 76 of the body 71 can be smoothly discharged.

The operation of the above structural washing machine will now be explained with reference to the attached drawings.

Clothes are put into the basket 30 having a predetermined volume of water. Firstly, the pulsator 40 is oscillated by the power transmitting means 60. Part of the water over the pulsator flows down the under surface of the pulsator 40 through a plurality of openings (not shown) formed in the pulsator 40. The plurality of vanes 43 formed on the lower surface of the pulsator 40 simultaneously move with the pulsator 40. The plurality of vanes 43 are utilized as an impeller. Since each vane 43 is configurated in a straight line, the water between the under surface of the pulsator 40 and the upper surface of the bottom of the water container 20 is radially spread regardless of the direction of rotation of the pulsator 40. The water contained on each vane 43 is forcefully directed to each inlet 72 of the channels 70. The water from each inlet 72 is forced up along the passage 76 of the respective body 71 by the rotation of the impeller. Part of the rising water is discharged through the third outlet 73, and is poured forth as the peripheral portion of the swirling water in the dehydrating basket 30.

Most of the rising water flows into the vortex chamber 84. Due to the vortex effect in the chamber 84, the lint and the water are easy separated. The lint water-laden is relatively heavier, while the water lighter. Thus, the water is guided toward the first outlet 81, and the lint is directed to the second outlet 82 to be collected by the filter 83. The water passing through each first outlet 81 is discharged toward the central area of the water surface in the basket 30. Since a plurality of first outlets 81 are disposed around the upper edge of the basket 30, the falling water can powerfully force the water in the basket downwardly.

At the initial washing operation, part of the dry clothes are above the water surface, but the water falling down through a plurality of first outlets 81 can soon immerse all the clothes. Next, as the pulsator 40 is oscillated during the main washing cycle, the clothes at the bottom of the basket 30 rise toward the upper central portion of the water. The falling water from each first outlet 81 forces the rising clothes to be immersed again, pushing the clothes under the surface of the water. Additionally, the falling water pushes against the rising clothes in the basket 30.

Further, the efflux of the water from the third outlet 73 causes the water in the basket 30 to be more turbulent. The water from the third outlet 73 also forces the clothes toward the middle portion of the basket 30.

Thus, the efflux dropping radially down from the first (highest) outlet 81 obstructs the clothes attempting to rise above the surface of the water. The efflux strikes the clothes under the water surface, thereby increasing the washing efficiency. Besides, relatively lint-free water is discharged through the first outlet 81, thereby avoiding resistance as could otherwise be created by the presence of the water. More, the efflux from the third (lowest) outlet supports the turbulence of the water and at the same time strikes the clothes. Thus, this leads to an increase of the washing efficiency.

What is claimed is:

1. A clothes washing machine, comprising:

a water container;

a dehydrating basket disposed in said water container and mounted for rotation about a vertical axis, said basket including a bottom wall and a vertical wall;

an agitator situated above said bottom wall and mounted for oscillation about said axis, said agitator including a plurality of generally radially extending vanes for discharging water in a generally radially outward direction in response to oscillation of said agitator;

at least one upright passage disposed in said vertical wall of said basket, said passage including a water inlet disposed adjacent a lower end thereof, a first water outlet disposed adjacent an upper end thereof, and a second water outlet disposed below said first water outlet;

a filter mounted at said second outlet for filtering-out lint from water discharged through said second water outlet; and a drive mechanism for rotating said basket and rotatably oscillating said agitator for displacing water upwardly through said passage and out of said first and second water outlets;

wherein said passage includes an enlargement adjacent said first and second water outlets for defining a vortex chamber with which said first and second outlets communicate.

2. The clothes washing machine according to claim 1, wherein there is a plurality of said passages spaced apart circumferentially.

3. The clothes washing machine according to claim 1, wherein an overhead wall of said vortex chamber includes a generally vertical rear end and a generally horizontal front end and is smoothly curved from said rear end to said front end.

4. The clothes washing machine according to claim 1, wherein said passage includes a third water outlet disposed below said second water outlet and below a water level in said basket.

5. The clothes washing machine according to claim 4, further including a vane disposed in a path of water running upwardly through said passage for diverting a portion of that water to said third water outlet.

6. The clothes washing machine according to claim 1, wherein said agitator vanes are disposed on a bottom surface of said agitator and lie at the same level as said water inlet.

7. The clothes washing machine according to claim 1, wherein said passage includes radially spaced inner and outer vertical walls and side walls extending between said inner and outer walls.

8. A clothes washing machine, comprising:

a water container including means for filling said water container with wash water to a predetermined level;

a dehydrating basket disposed in said water container and mounted for rotation about a vertical axis, said basket including a bottom wall and a vertical wall;

an agitator situated above said bottom wall and mounted for oscillation about said axis, said agitator including a plurality of generally radially extending vanes for displacing water in a generally radially outward direction in response to oscillation of said agitator;

at least one upright passage disposed in said vertical wall of said basket, said passage including a water inlet disposed adjacent a lower end thereof, a water outlet situated above said predetermined level and a water outlet situated below said level;

a drive mechanism for rotating said basket and oscillating said agitator for displacing water upwardly through said passage and out of said water outlets; and a vane disposed in the path of water running upwardly through said passage for diverting a portion of that water through said water outlet disposed below said predetermined level.

9. The clothes washing machine according to claim 8, wherein there is a plurality of said passages spaced circumferentially apart.

10. The clothes washing machine according to claim 8, wherein said passage includes radially spaced inner and outer vertical walls, and side walls extending between said inner and outer walls.

* * * * *